US008009181B2

(12) United States Patent
Nakanishi

(10) Patent No.: US 8,009,181 B2
(45) Date of Patent: Aug. 30, 2011

(54) DISPLAY METHOD AND DISPLAY APPARATUS USING THIS METHOD

(75) Inventor: Kunifumi Nakanishi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1062 days.

(21) Appl. No.: 11/831,155

(22) Filed: Jul. 31, 2007

(65) Prior Publication Data

US 2008/0111838 A1 May 15, 2008

(30) Foreign Application Priority Data

Nov. 13, 2006 (JP) ..... 2006-306164

(51) Int. Cl.
*G09G 3/36* (2006.01)
*G09G 5/10* (2006.01)

(52) U.S. Cl. ..... 345/690; 345/87; 345/89; 345/692; 345/77; 345/204

(58) Field of Classification Search ..... 345/87, 345/98, 690–692, 63, 77, 89, 204
See application file for complete search history.

(56) References Cited

U.S. PATENT DOCUMENTS

2007/0126758 A1* 6/2007 Hwang ..... 345/690

FOREIGN PATENT DOCUMENTS

| | | |
|---|---|---|
| JP | 5-72991 | 3/1993 |
| JP | 6-161391 | 6/1994 |
| JP | 10-49108 | 2/1998 |
| JP | 2003-288058 | 10/2003 |

* cited by examiner

*Primary Examiner* — Lun-Yi Lao
*Assistant Examiner* — Sosina Abebe
(74) *Attorney, Agent, or Firm* — Oblon, Spivak, McClelland, Maier & Neustadt, L.L.P.

(57) ABSTRACT

An object of the present invention is to provide a display method capable of displaying all gray levels of an input image signal with reduced flicker, and a display apparatus using this method. The present invention provides a display method that allows a display apparatus to display gray levels represented by a first number of bits of an image signal inputted to a driver circuit that drives the display apparatus, when the first number of bits is larger than a second number of bits of gray-level data outputted from the driver circuit. The display method of the present invention includes a first pseudo gray-level display step of performing frame rate control while handling a first number of frames as one set, so as to add pseudo gray levels into the intervals between the individual gray levels represented by the second number of bits, and a second pseudo gray-level display step of performing frame rate control while handling a second number of frames as one set, so as to add at least one pseudo gray level into at least one of the intervals between the individual gray levels to which the first pseudo gray-level display step has been applied, wherein the second number of frames is different from the first number of frames.

12 Claims, 4 Drawing Sheets

DISPLAY METHOD AND DISPLAY APPARATUS USING THIS METHOD

BACKGROUND OF THE INVENTION

1. Field of the Invention

The present invention relates to a display method and a display apparatus using this method, and particularly to a display method related to gray-level representation and a display apparatus using this method.

2. Description of the Background Art

In recent years, the input image signal to a matrix-type image display apparatus (which is hereinafter also referred to simply as a display apparatus) has an increased number of bits because of improved data processing ability and the like, and the number of bits of the input image signal may exceed the number of bits that the data driver IC can output. That is, the number of representable gray levels of a display apparatus depends on the performance of the data driver IC, and phenomena like "missing of gradations" and "slipping of tone" occur when the number of bits that the data driver IC can output is smaller than the number of bits of the input image signal. When phenomena like missing of gradations and slipping of tone occur, the display apparatus cannot faithfully reproduce images as the user intends.

Then, faithfully reproducing images in the display apparatus requires changing the data driver IC so that it can output a larger number of bits than the input image signal. However, configuring the data driver IC so that it can output an increased number of bits involves increased costs for the data driver IC. Accordingly, for example, the FRC (Frame Rate Control) may be adopted so that the gray levels represented by the number of bits of the input image signal can be expressed even when the data driver IC is only capable of outputting a smaller number of bits than the number of bits of the input image signal.

In the FRC, for display of one pixel dot in m frames (one period), a gray level Gp is displayed in n frames ($n<m$), and a gray level Gq is displayed in the remaining (m−n) frames, so that the viewer's eyes recognize a gray level (a pseudo gray level) that corresponds to a weighted time mean based on the ratio of frames of the gray level Gp and the gray level Gq. Specifically, a display apparatus adopting the FRC is disclosed in Japanese Patent Application Laid-Open No. 10-49108 (1998), for example.

However, when a j-bit input image signal is displayed with a data driver IC that is capable of outputting i bits ($i<j$), the number of representable gray levels is still insufficient even when the display apparatus adopts FRC. Specifically, when $\{2^{(j-i)}-1\}$ pseudo gray levels are generated by FRC between individual i-bit gray levels by handling $2^{(j-i)}$ frames as one set, the display apparatus is then capable of outputting $\{2^j-2^{(j-i)}+1\}$ gray levels. However, the number of gray levels is still fewer by $2^{(j-i)}-1$ than the number of gray levels ($2^j$) of the input image signal to be displayed. The lack of gray levels results in so-called "missing of gradations" in displayed images.

To solve the missing of gradations and obtain the absent gray levels, it is necessary to apply the frame rate control (FRC) with a different number of frames from $2^{(j-i)}$ only between certain gray levels Gr and Gr+1. Specifically, in a method for remedying the lack of gray levels, $\{2^{(j-i+1)}-1\}-1$ pseudo gray levels are generated by handling $\{2^{(j-i+1)}-1\}$ frames as one set, where $\{2^{(j-i+1)}-1\}$ is the sum of $2^{(j-i)}$ and $\{2^{(j-i)}-1\}$ that is equal to the number of absent gray levels.

However, in this conventional display method, while pseudo gray levels between some gray levels are generated by handling $2^{(j-i)}$ frames as one set, pseudo gray levels between other gray levels are generated by handling $\{2^{(j-i+1)}-1\}$ frames as one set, in order to remedy the lack of gray levels. Accordingly, when an image changes in time between the two pseudo gray level ranges, the frequency becomes extremely smaller when pseudo gray levels with $\{2^{(j-i+1)}-1\}$ frames are displayed, than when pseudo gray levels with $2^{(j-i)}$ frames are displayed, and it is likely to be recognized as flicker by human eyes.

SUMMARY OF THE INVENTION

An object of the present invention is to provide a display method capable of displaying all gray levels of an input image signal with reduced flicker, and a display apparatus using this method.

A display method of the present invention allows a display apparatus to display gray levels represented by a first number of bits of an image signal inputted to a driver circuit that drives the display apparatus, when the first number of bits is larger than a second number of bits of gray-level data outputted from the driver circuit, and the display method includes a first pseudo gray-level display step and a second pseudo gray-level display step. The first pseudo gray-level display step performs frame rate control while handling a first number of frames as one set, so as to add pseudo gray levels into the intervals between the individual gray levels represented by the second number of bits. The second pseudo gray-level display step performs frame rate control while handling a second number of frames as one set, so as to add at least one pseudo gray level into at least one of the intervals between the individual gray levels to which the first pseudo gray-level display step has been applied, where the second number of frames is different from the first number of frames.

According to the display method of the present invention, at least one pseudo gray level generated in the second pseudo gray-level display step is added into at least one of the intervals between gray levels to which the first pseudo gray-level display step has been applied, whereby all of the gray levels of the input image signal can be displayed with reduced flicker.

Another display method of the present invention allows a display apparatus to display gray levels represented by a first number of bits of an image signal inputted to a driver circuit that drives the display apparatus, when the first number of bits is larger than a second number of bits of gray-level data outputted from the driver circuit, and the display method includes a first pseudo gray-level display step and a second pseudo gray-level display step. The first pseudo gray-level display step performs frame rate control while handling a given number of frames as one set, so as to add pseudo gray levels into the intervals between adjacent ones of the gray levels represented by the second number of bits. The second pseudo gray-level display step performs frame rate control while handling a given number of frames as one set, so as to add at least one pseudo gray level into at least one set of two consecutive intervals between the gray levels represented by the second number of bits.

According to the display method of the present invention, at least one pseudo gray level generated by performing FRC by handling a given number of frames as one set is added into at least one set of two consecutive intervals between gray levels, whereby the frequency of FRC is increased, and flicker is reduced when luminance differences between gray levels are relatively small.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Figure 1:
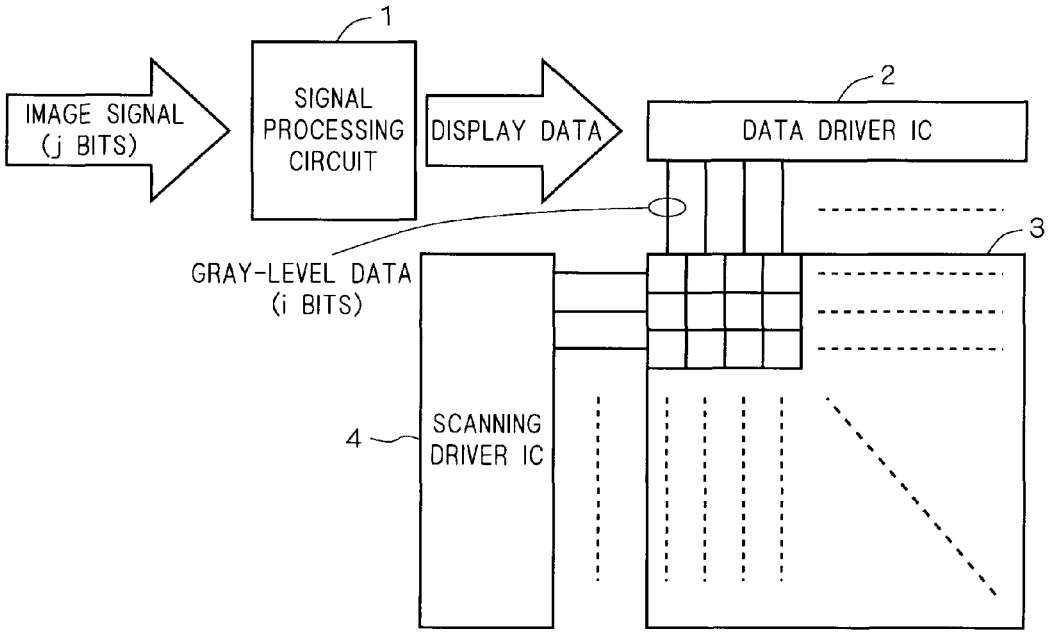
FIG. 1 is a block diagram of a display apparatus according to a first preferred embodiment of the present invention.

FIG. 1 is a block diagram illustrating the circuit configuration of a matrix-type image display apparatus (hereinafter also referred to simply as a display apparatus) according to this preferred embodiment. In the display apparatus of FIG. 1, a j-bit input image signal (hereinafter also referred to simply as an image signal) is inputted to a signal processing circuit 1, and the signal processing circuit 1 converts the image signal to a digital signal according to the level. Also, the signal processing circuit 1 applies timing adjustment and level adjustment to the digital signal, and outputs it as display data to a data driver IC 2.

The data driver IC 2 supplies the inputted display data as gray-level data (i bits) to a display panel 3. Also, a scanning driver IC 4 supplies a scanning signal to individual pixels in the display panel 3. The individual pixels in the display panel 3 display the gray-level data supplied from the data driver IC 2 while the scanning signal is being supplied thereto. Though not shown in FIG. 1, the display apparatus also includes a timing controller that controls timings of driving of the data driver IC 2 and the scanning driver IC 4.

In the display apparatus shown in FIG. 1, the number of bits of the image signal is "j", while the number of bits of the gray-level data outputted from the data driver IC 2 is "i". Then, when "i" is smaller than "j", phenomena like missing of gradations and slipping of tone occur, and the images cannot be faithfully displayed. Accordingly, the display apparatus of this preferred embodiment adopts an FRC (Frame Rate Control) method so that the gray levels of the displayed images can be represented by the data driver IC 2 that is capable of outputting a smaller number of gray levels than the gray levels of the displayed images.

In the FRC method, as described about the background art, for display of one pixel dot in m frames (one period), a gray level Gp is displayed in n frame(s) ($n<m$), and a gray level Gq is displayed in the remaining (m−n) frame(s), so that the viewer's eyes recognize a gray level (a pseudo gray level) that corresponds to a weighted time mean based on the ratio of frames of the gray level Gp and the gray level Gq.

Figure 2:
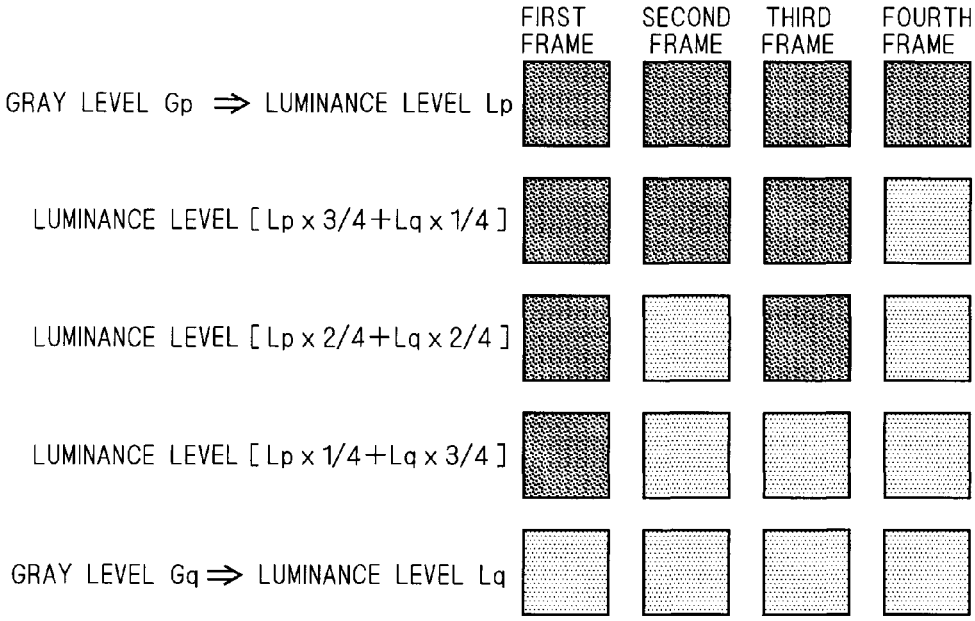
FIG. 2 is a diagram illustrating FRC in the display apparatus of the first preferred embodiment of the present invention.

The FRC method will be more specifically described referring to FIG. 2. First, FIG. 2 shows an example of the FRC method in which three pseudo gray levels are displayed between a gray level Gp (its luminance level is Lp) and a gray level Gq (its luminance level is Lq). In this example, the frame rate control (FRC) handles four frames as one set. That is, as shown in the second line in FIG. 2, three of the four frames display the gray level Gp, and the remaining one frame displays the gray level Gq, and then the luminance level is visually recognized as a weighted time mean [Lp×¾+Lq×¼] based on the ratio of frames of the gray levels Gp and Gq.

Similarly, as shown in the third line in FIG. 2, when each two of the four frames respectively display the gray levels Gp and Gq, the luminance level is visually recognized as [Lp×¾+ Lq×¾]=[(Lp+Lq)/2]. Also, as shown in the fourth line in FIG. 2, when one of the four frames displays the gray level Gp and the remaining three frames display the gray level Gq, then the luminance level is visually recognized as [Lp×¼+Lq×¾].

However, as described about the background art, when a j-bit image signal is displayed with the i-bit data driver IC 2 ($i<j$), the number of gray levels lacks by $2^{(j-i)}-1$, even when the FRC method is adopted.

By way of example, Table 1 illustrates the correspondence between an image signal and gray-level data in a display apparatus in which a 8-bit image signal (256 gray levels) is displayed with a data driver IC 2 capable of outputting 6-bit gray-level data (64 gray levels from 0 to 63).

TABLE 1

| Data driver IC output (6-bit gray level) | Luminance level by FRC ⇒ Image signal (8-bit gray level) | | |
|---|---|---|---|
| [0] | [0] | ⇒ | [0] |
| | [0] × ¾ + [1] × ¼ | ⇒ | [1] |
| | [0] × ¾ + [1] × ¾ | ⇒ | [2] |
| | [0] × ¼ + [1] × ¾ | ⇒ | [3] |
| [1] | [1] | ⇒ | [4] |
| | [1] × ¾ + [2] × ¼ | ⇒ | [5] |
| | [1] × ¾ + [2] × ¾ | ⇒ | [6] |
| | [1] × ¼ + [2] × ¾ | ⇒ | [7] |
| [2] | [2] | ⇒ | [8] |
| | [2] × ¾ + [3] × ¼ | ⇒ | [9] |
| | [2] × ¾ + [3] × ¾ | ⇒ | [10] |
| | [2] × ¼ + [3] × ¾ | ⇒ | [11] |
| . | . | | . |
| . | . | | . |
| . | . | | . |
| [62] | [62] | ⇒ | [248] |
| | [62] × ¾ + [63] × ¼ | ⇒ | [249] |
| | [62] × ¾ + [63] × ¾ | ⇒ | [250] |
| | [62] × ¼ + [63] × ¾ | ⇒ | [251] |
| [63] | [63] | ⇒ | [252] |

In Table 1, the left column shows the gray levels of the data driver IC 2, and the right column shows the luminance levels by FRC and the gray levels of the image signal. In Table 1, the FRC process handles four frames as a single set, and three pseudo gray levels are generated between the individual 6-bit gray levels.

In Table 1, however, the displayed gray levels are from 0 to 252, and the total number of gray levels is (64−1)×3+64=253. Thus, the gray-level data outputted from the data driver IC 2 includes gray levels that are fewer by 3 than the 256 gray levels of the image signal. In this case, the processing illustrating in Table 2 is adopted in general.

TABLE 2

| Data driver IC output (6-bit gray level) | Luminance level by FRC ⇒ Image signal (8-bit gray level) | | |
|---|---|---|---|
| [0] | [0] | ⇒ | [0] |
| | [0] × 3/4 + [1] × 1/4 | ⇒ | [1] |
| | [0] × 2/4 + [1] × 2/4 | ⇒ | [2] |
| | [0] × 1/4 + [1] × 3/4 | ⇒ | [3] |
| [1] | [1] | ⇒ | [4] |
| | [1] × 3/4 + [2] × 1/4 | ⇒ | [5] |
| | [1] × 2/4 + [2] × 2/4 | ⇒ | [6] |
| | [1] × 1/4 + [2] × 3/4 | ⇒ | [7] |
| [2] | [2] | ⇒ | [8] |
| | [2] × 3/4 + [3] × 1/4 | ⇒ | [9] |
| | [2] × 2/4 + [3] × 2/4 | ⇒ | [10] |
| | [2] × 1/4 + [3] × 3/4 | ⇒ | [11] |
| . | . | | . |
| . | . | | . |
| . | . | | . |
| [62] | [62] | ⇒ | [248] |
| | [62] × 3/4 + [63] × 1/4 | ⇒ | [249] |
| | [62] × 2/4 + [63] × 2/4 | ⇒ | [250] |
| | [62] × 1/4 + [63] × 3/4 | ⇒ | [251] |
| [63] | [63] | ⇒ | [252] |
| | [63] | ⇒ | [253] |
| | [63] | ⇒ | [254] |
| | [63] | ⇒ | [255] |

In Table 2, among the gray levels 0 to 255 of the image signal, the gray levels 252 to 255 are displayed as the same luminance level (the gray level 63 of the data driver IC 2), and so the displayed image suffers so-called "missing of gradations". In Table 2, the FRC produces pseudo gray levels from the lower gray levels, and so the "missing of gradations" occurs at the higher gray levels. However, when the FRC produces pseudo gray levels from the higher gray levels, then "missing of gradations" occurs at the lower gray levels.

In order to solve the missing of gradations and to obtain the absent gray levels, the example explained about the background art generates pseudo gray levels using a different number of frames as one set, only between certain gray levels Gr and Gr+1. Specifically, when this is applied to the example of Table 1, as shown in Table 3, the FRC is performed by using seven frames as one unit only between the gray levels 62 and 63 of the data driver IC 2 to obtain the absent three gray levels.

TABLE 3

| Data driver IC output (6-bit gray level) | Luminance level by FRC ⇒ Image signal (8-bit gray level) | | |
|---|---|---|---|
| [0] | [0] | ⇒ | [0] |
| | [0] × 3/4 + [1] × 1/4 | ⇒ | [1] |
| | [0] × 2/4 + [1] × 2/4 | ⇒ | [2] |
| | [0] × 1/4 + [1] × 3/4 | ⇒ | [3] |
| [1] | [1] | ⇒ | [4] |
| | [1] × 3/4 + [2] × 1/4 | ⇒ | [5] |
| | [1] × 2/4 + [2] × 2/4 | ⇒ | [6] |
| | [1] × 1/4 + [2] × 3/4 | ⇒ | [7] |
| [2] | [2] | ⇒ | [8] |
| | [2] × 3/4 + [3] × 1/4 | ⇒ | [9] |
| | [2] × 2/4 + [3] × 2/4 | ⇒ | [10] |
| | [2] × 1/4 + [3] × 3/4 | ⇒ | [11] |
| . | . | | . |
| . | . | | . |
| . | . | | . |
| [62] | [62] | ⇒ | [248] |
| | [62] × 6/7 + [63] × 1/7 | ⇒ | [249] |
| | [62] × 5/7 + [63] × 2/7 | ⇒ | [250] |
| | [62] × 4/7 + [63] × 3/7 | ⇒ | [251] |
| | [62] × 3/7 + [63] × 4/7 | ⇒ | [252] |
| | [62] × 2/7 + [63] × 5/7 | ⇒ | [253] |
| | [62] × 1/7 + [63] × 6/7 | ⇒ | [254] |
| [63] | [63] | ⇒ | [255] |

That is, in Table 3, six pseudo gray levels are added between the gray levels 62 and 63 of the data driver IC 2, so as to obtain (64−2)×4+7+1=256 gray levels in total. While this example handles seven frames as one unit, eight frames may be handled as one unit for the sake of convenience of the algorithm of the signal processing circuit 1, in which case six of the generated seven pseudo gray levels are used.

When 8-bit gray-level data (256 gray levels) is thus displayed with the 6-bit data driver IC 2 (64 gray levels), the pseudo gray levels of and below the level 247 of the gray-level data correspond to gray levels {4n−3}, {4n−2} and {4n−1} (n is a natural number), and the cycle of change between two gray levels is 4 frames (frequency is 15 Hz in general). On the other hand, at the pseudo gray levels of and above the level 249 of the gray-level data, the cycle of change between two gray levels is seven frames, which means a lower frequency (frequency is about 8 Hz). Accordingly, human eyes will see flicker when the image changes in time between 4-frame pseudo gray levels and 7-frame pseudo gray levels.

Figure 3:
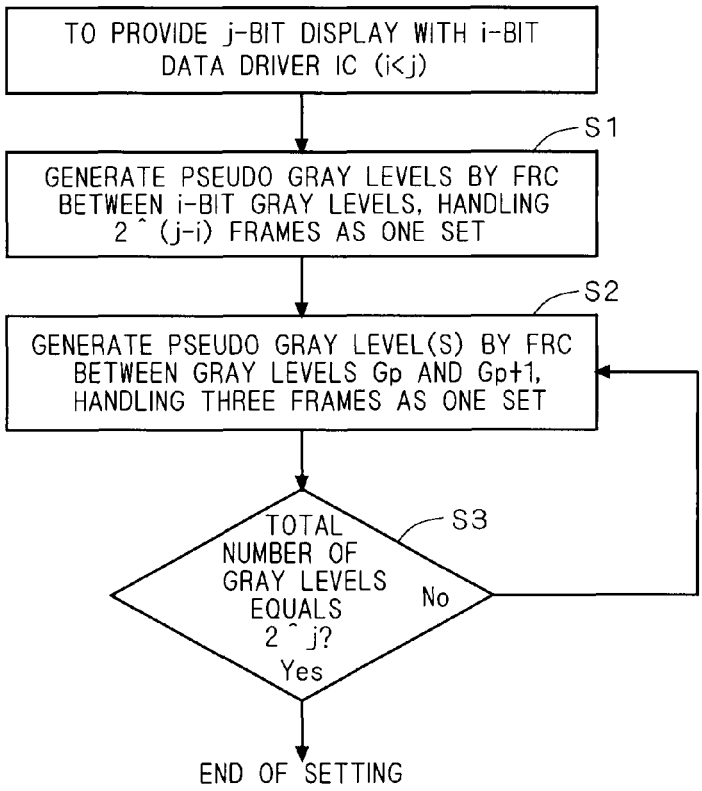
FIG. 3 is a flowchart illustrating a display method of the first preferred embodiment of the present invention.

Accordingly, the display apparatus of this preferred embodiment adopts the display method described below which makes it possible to display all gray levels of the input image signal, while suppressing flicker. FIG. 3 is a flowchart illustrating the display method of the preferred embodiment. In the flowchart of FIG. 3, the gray levels of a j-bit image signal is displayed by using a data driver IC 2 capable of outputting i-bit gray-level data (i<j). In the flowchart of FIG. 3, first, FRC is performed while handling 2^(j−i) frames as one set, to generate 2^(j−i)−1 pseudo gray levels between individual i-bit gray levels (Step S1). Step S1 makes it possible to display gray levels including the 2^i gray levels not generated by FRC plus the {2^j−2^i−2^(j−i)+1 } gray levels generated by FRC.

Next, for the lack of {2^(j−1)−1} gray levels from the 2^j gray levels of the image signal, FRC is performed while handling three frames as one set between gray levels Gp and Gp+1, so as to generate pseudo gray levels {Gp×⅔+(Gp+1)×⅓} and {Gp×⅓+(Gp+1)×⅔} (Step S2). That is, in the display method of this preferred embodiment, pseudo gray levels generated by FRC with four frames handled as one set and pseudo gray levels generated by FRC with three frames handled as one set coexist between certain gray levels.

When the number of absent gray level(s) {2^(j−i)−1} is one, either of {Gp×⅔+(Gp+1)×⅓} and {Gp×⅓+(Gp+1)×⅔} can be used. When the number of absent gray levels is three, two pseudo gray levels generated in Step S2 are used between the gray levels Gp and Gp+1, and one pseudo gray level generated in Step S2 is used between other gray levels Gq and Gq+1.

Next, pseudo gray levels generated in Step S2 are added between gray levels until the total of the i-bit gray levels and the pseudo gray levels added in Step S1 and Step S2 reaches the number of gray levels 2^j of the image signal (Step S3).

A specific example of the display method of this preferred embodiment is shown in Table 4.

TABLE 4

| Data driver IC output (6-bit gray level) | Luminance level by FRC ⇒ Image signal (8-bit gray level) | | |
|---|---|---|---|
| [0] | [0] | ⇒ | [0] |
| | [0] × 3/4 + [1] × 1/4 | ⇒ | [1] |
| | [0] × 2/4 + [1] × 2/4 | ⇒ | [2] |
| | [0] × 1/4 + [1] × 3/4 | ⇒ | [3] |

TABLE 4-continued

| Data driver IC output (6-bit gray level) | | Luminance level by FRC ⇒ Image signal (8-bit gray level) | | |
|---|---|---|---|---|
| [1] | | [1] | ⇒ | [4] |
| | | [1] × ¾ + [2] × ¼ | ⇒ | [5] |
| | | [1] × ⅔ + [2] × ⅔ | ⇒ | [6] |
| | | [1] × ¼ + [2] × ¾ | ⇒ | [7] |
| [2] | | [2] | ⇒ | [8] |
| | | [2] × ¾ + [3] × ¼ | ⇒ | [9] |
| | | [2] × ⅔ + [3] × ⅔ | ⇒ | [10] |
| | | [2] × ¼ + [3] × ¾ | ⇒ | [11] |
| . | | . | | . |
| . | | . | | . |
| . | | . | | . |
| [61] | | [61] | ⇒ | [244] |
| | | [61] × ¾ + [62] × ¼ | ⇒ | [245] |
| | * | [61] × ⅔ + [62] × ⅓ | ⇒ | [246] |
| | | [61] × ⅔ + [62] × ⅔ | ⇒ | [247] |
| | | [61] × ¼ + [62] × ¾ | ⇒ | [248] |
| [62] | | [62] | ⇒ | [249] |
| | | [62] × ¾ + [63] × ¼ | ⇒ | [250] |
| | * | [62] × ⅔ + [63] × ⅓ | ⇒ | [251] |
| | | [62] × ⅔ + [63] × ⅔ | ⇒ | [252] |
| | * | [62] × ⅓ + [63] × ⅔ | ⇒ | [253] |
| | | [62] × ¼ + [63] × ¾ | ⇒ | [254] |
| [63] | | [63] | ⇒ | [255] |

Table 4 shows an example in which 8-bit gray-level data (256 gray levels) is displayed with the data driver IC 2 having a 6-bit output (64 gray levels). First, FRC is performed while handling four (2^(8−6)) frames as one set, so as to generate three pseudo gray levels between the individual 6-bit gray levels. This process corresponds to Step S1, and the total number of gray levels, including the generated pseudo gray levels, is (64−1)×4+1=253. The number of gray levels is fewer by 3 than the 256 gray levels of the input image signal.

Then, FRC is performed between the gray levels [62] and [63] while handling three frames as one set, so as to add pseudo gray levels {[62]×⅔+[63]×⅓} and {[62]×⅓+[63]×⅔} (Step S2). In this process, the two pseudo gray levels generated by using three frames as one unit are compared with the three pseudo gray levels generated by using four frames as one unit, and the pseudo gray levels are associated with the 8-bit gray levels from the lower level.

In Table 4, the pseudo gray level {[62]×⅔+[63]×⅓} is associated with the gray level {251}, and the pseudo gray level {[62]×⅓+[63]×⅔} is associated with the gray level {253}. Also, between the gray levels [61] and [62], a pseudo gray level {[61]×⅔+[62]×⅓} is generated by FRC using three frames as one set, and associated with the gray level {246}.

As described above, in this preferred embodiment, when a j-bit image signal is displayed by using the data driver IC 2 capable of outputting i-bit gray levels (i<j), pseudo gray levels generated by FRC handling 2^(j−i) frames as one set are added between the individual i-bit gray levels. Furthermore, for the lack of gray levels of {2^(j−i)−1}, FRC is performed using three frames as one set to add pseudo gray levels. The maximum number of gray levels that can be added is 2×(2^i−1). If the number of gray levels is still insufficient after pseudo gray levels are added in this way, pseudo gray levels can be generated and added by FRC using five frames as one set, or seven frames as one set. According to the display method of this preferred embodiment and the display apparatus using the display method, it is possible to display all the gray levels 2^j of the input image signal, with reduced flicker.

Second Preferred Embodiment

Figure 4:
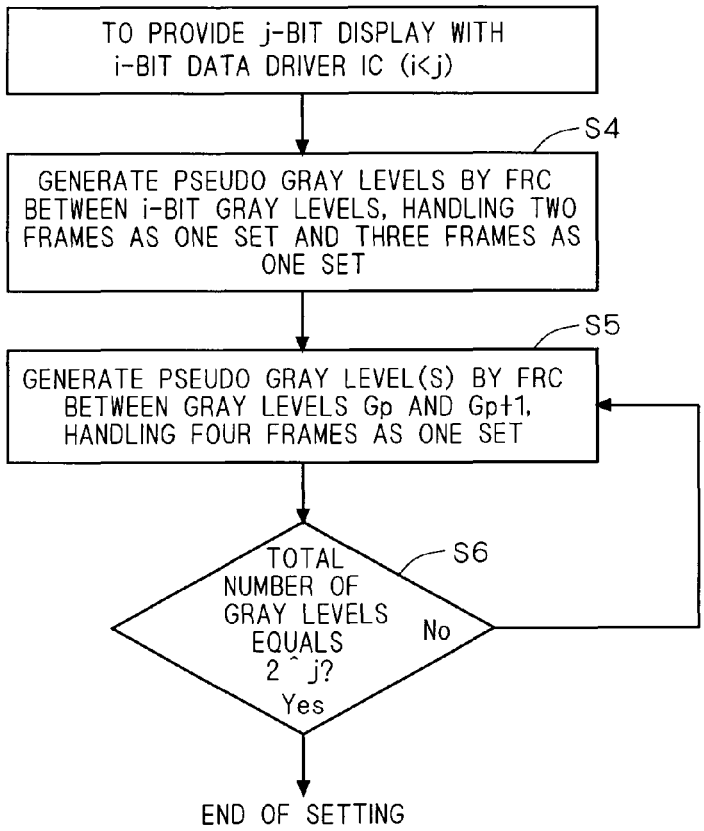
FIG. 4 is a flowchart illustrating a display method according to a second preferred embodiment of the present invention.

FIG. 4 is a flowchart illustrating a display method according to this preferred embodiment. In the flowchart of FIG. 4, the gray levels of a j-bit image signal are displayed by using a data driver IC 2 that is capable of outputting i-bit gray-level data (i<j). In the flowchart of FIG. 4, first, FRC is performed while handling two frames as one set and three frames as one set, so as to generate and add pseudo gray levels between the individual i-bit gray levels (Step S1). For example, between gray levels Gk and Gk+1, FRC is performed using two frames as one set to generate and add a pseudo gray level {Gk×½+(Gk+1)×½}, and FRC is further performed using three frames as one set to generate and add pseudo gray levels {Gk×⅔+(Gk+1)×⅓} and {Gk×⅓+(Gk+1)×⅔}.

The total number of gray levels, including these pseudo gray levels and the original i-bit gray levels, is 2^i+(2^i−1)+(2^i−1)×2=2^(i+2)−3. The total number of gray levels is fewer by {2^j−2^(i+2)+3} than the number of gray levels 2^j of the input image signal.

Next, between gray levels Gp and Gp+1, FRC is performed using four frames as one set, so as to generate and add pseudo gray levels {Gp×¼+(Gp+1)×¾} and {Gp×¾+(Gp+1)×¼}, for the lack of gray levels (Step S5). In this process, when the number of absent gray level(s) {2^j−2^(i+2)+3} is one, either of {Gp×¼+(Gp+1)×¾} and {Gp×¾+(Gp+1)×¼} can be used. When the number of absent gray levels is three, two gray levels generated in Step S5 are added between gray levels Gp and Gp+1, and one pseudo gray level generated in Step S5 is added between other gray levels Gq and Gq+1.

Next, pseudo gray levels generated in Step S5 are added between gray levels until the total of the i-bit gray levels and the pseudo gray levels added in Step S4 and Step S5 reaches the number of gray levels 2^j of the image signal (Step S6).

A specific example of the display method of this preferred embodiment is shown in Table 5.

TABLE 5

| Data driver IC output (6-bit gray level) | | Luminance level by FRC ⇒ Image signal (8-bit gray level) | | |
|---|---|---|---|---|
| [0] | | [0] | ⇒ | [0] |
| | | [0] × ⅔ + [1] × ⅓ | ⇒ | [1] |
| | | [0] × ½ + [1] × ½ | ⇒ | [2] |
| | | [0] × ⅓ + [1] × ⅔ | ⇒ | [3] |
| [1] | | [1] | ⇒ | [4] |
| | | [1] × ⅔ + [2] × ⅓ | ⇒ | [5] |
| | | [1] × ½ + [2] × ½ | ⇒ | [6] |
| | | [1] × ⅓ + [2] × ⅔ | ⇒ | [7] |
| [2] | | [2] | ⇒ | [8] |
| | | [2] × ⅔ + [3] × ⅓ | ⇒ | [9] |
| | | [2] × ½ + [3] × ½ | ⇒ | [10] |
| | | [2] × ⅓ + [3] × ⅔ | ⇒ | [11] |
| . | | . | | . |
| . | | . | | . |
| . | | . | | . |
| [61] | | [61] | ⇒ | [244] |
| | * | [61] × ¾ + [62] × ¼ | ⇒ | [245] |
| | | [61] × ⅔ + [62] × ⅓ | ⇒ | [246] |
| | | [61] × ½ + [62] × ½ | ⇒ | [247] |
| | | [61] × ⅓ + [62] × ⅔ | ⇒ | [248] |
| [62] | | [62] | ⇒ | [249] |
| | * | [62] × ¾ + [63] × ¼ | ⇒ | [250] |
| | | [62] × ⅔ + [63] × ⅓ | ⇒ | [251] |
| | | [62] × ½ + [63] × ½ | ⇒ | [252] |
| | | [62] × ⅓ + [63] × ⅔ | ⇒ | [253] |
| | * | [62] × ¼ + [63] × ¾ | ⇒ | [254] |
| [63] | | [63] | ⇒ | [255] |

Table 5 shows an example in which 8-bit gray-level data (256 gray levels) is displayed with the data driver IC 2 having a 6-bit output (64 gray levels). First, FRC is performed while handling two frames as one set and three frames as one set, so as to generate three pseudo gray levels between the individual 6-bit gray levels. This process corresponds to Step S4, and the total number of gray levels, including the generated pseudo gray levels, is (64−1)×4+1=253. The number of gray levels is fewer by 3 than the 256 gray levels of the input image signal.

Then, between the gray levels [62] and [63], FRC is performed using four frames as one set, so as to add pseudo gray levels {[62]×¾+[63]×¼} and {[62]×¼+[63]×¾} (Step S5). In this process, the two pseudo gray levels generated using four frames as one unit are compared with the three pseudo gray levels generated using two frames as one unit and three frames as one unit, and the pseudo gray levels are associated with the 8-bit gray levels from the lower level. In Table 4, the pseudo gray level {[62]×¾+[63]×¼} is associated with the gray level {250}, and the pseudo gray level {[62]×¼+[63]×¾} is associated with the gray level {254}. Also, between the gray levels [61] and [62], a pseudo gray level {[61]×¾+
[62]×¼} is generated by FRC using four frames as one set, and associated with the gray level {245}.

As described above, in the display method of this preferred embodiment, when a j-bit image signal is displayed by using the data driver IC 2 capable of outputting i-bit gray levels (i<j), pseudo gray levels generated by FRC handling two frames as one set and three frames as one set are added between the individual i-bit gray levels. Furthermore, for the insufficient gray levels {2^(i+2)−3}, the display method of this preferred embodiment performs FRC by handling four frames as one set to add pseudo gray levels. In the case of FRC using four frames as one set, the maximum number of pseudo gray levels that can be added is 2×(2^i−1). If the number of gray levels is still insufficient, FRC can be performed by using five frames as one set, or seven frames as one set, to further add pseudo gray levels.

According to the display method of this preferred embodiment and the display apparatus using the display method, pseudo gray levels are generated by FRC handing n frames (n=2, 3, 4, . . . ) as one set, and so the frame frequency of pseudo gray levels can be as high as possible, and it is possible to display all the gray levels of the input image signal while suppressing flicker.

Third Preferred Embodiment

Figure 5:
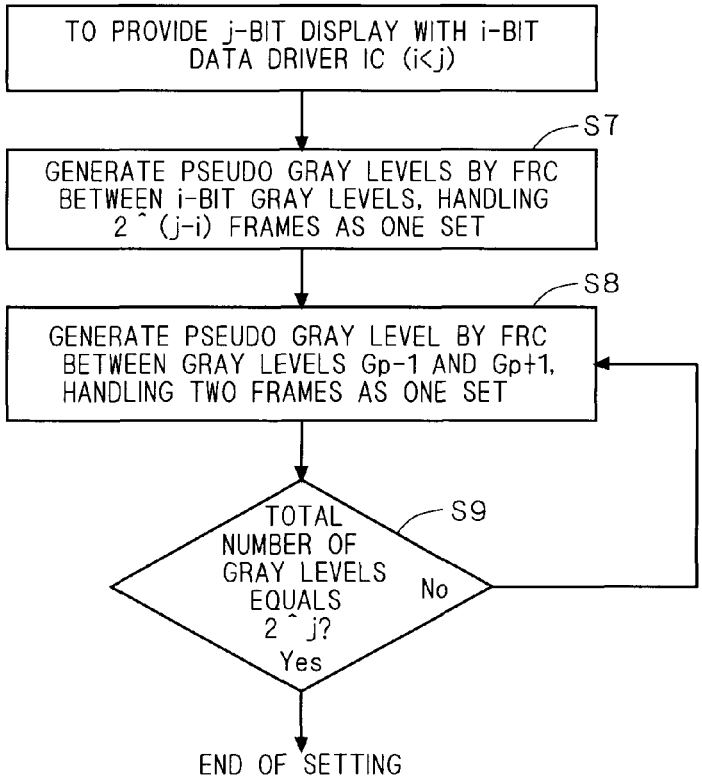
FIG. 5 is a flowchart illustrating a display method according to a third preferred embodiment of the present invention.

FIG. 5 is a flowchart illustrating a display method according to this preferred embodiment. In the flowchart of FIG. 5, when the gray levels of a j-bit image signal are displayed by using a data driver IC 2 capable of outputting i-bit gray-level data (i<j), first, FRC is performed by handling 2^(j−i) frames as one set, so as to generate pseudo gray levels between the individual i-bit gray levels (Step S7). Step S7 makes it possible to display gray levels including the 2^i gray levels not generated by FRC plus the {2^j−2^i−2^(j−i)+1 } gray levels generated by FRC.

Next, for the lack of {2^(j−i)−1} gray levels after the addition of pseudo gray levels in Step S7, FRC is performed using two frames as one set, so as to generate and add a pseudo gray level Gc between a gray level Gp−1 (its luminance level is Lp−1) and a gray level Gp+1 (its luminance level is Lp+1) (in the two consecutive intervals between the gray levels) (Step S8). The luminance level of the pseudo gray level Gc generated in Step S8 is {(Lp−1)+(Lp+1)}/2, and this pseudo gray level and the pseudo gray levels generated in Step S7 between the gray levels Gp−1 and Gp+1 are arranged by checking the values of the luminance levels of the pseudo gray levels.

Figure 6:
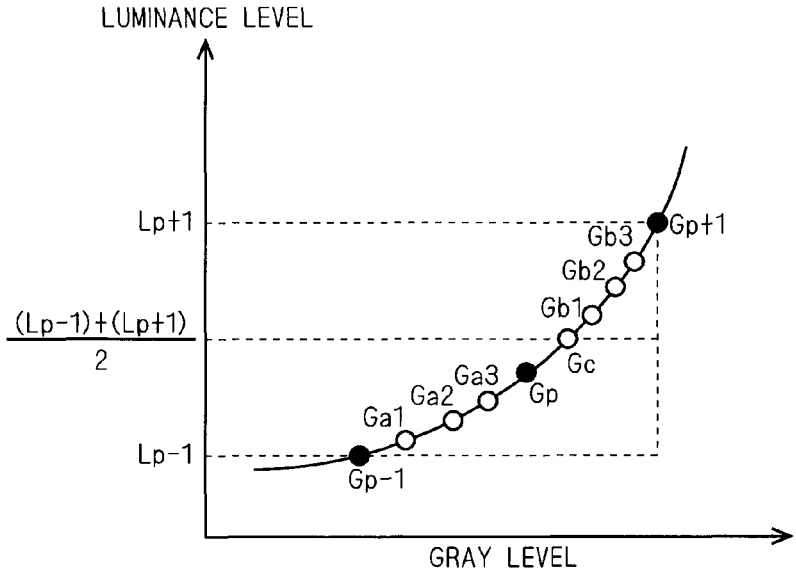
FIG. 6 is a diagram illustrating a relation between gray levels and luminance levels in the third preferred embodiment of the present invention.

For example, FIG. 6 shows a relation between the luminance levels and gray levels between the gray levels Gp−1 and Gp+1. In FIG. 6, the horizontal axis shows the gray level and the vertical axis shows the luminance level. FIG. 6 shows three pseudo gray levels Ga1, Ga2, and Ga3 generated by FRC handling four frames as one set between the gray levels Gp−1 and Gp, and three pseudo gray levels Gb1, Gb2, and Gb3 generated by FRC handling four frames as one set between the gray levels Gp and Gp+1.

FIG. 6 further shows the pseudo gray level Gc generated by FRC handling two frames as one set between the gray levels Gp−1 and Gp+1, and the position of this pseudo gray level Gc is determined by comparing its luminance level ({Lp−1}+(Lp+1)}/2) and the luminance levels of the other pseudo gray levels Ga1, Ga2, Ga3, Gb1, Gb2, and Gb3. In the example of FIG. 6, the luminance levels are in the relation "gray level Gp<pseudo gray level Gc<pseudo gray level Gb1", and so the pseudo gray level Gc is positioned between the gray level Gp and the pseudo gray level Gb1.

Next, pseudo gray levels generated in Step S8 are added into two consecutive intervals between gray levels until the total of the pseudo gray levels added in Step S7 and Step S8 and the i-bit gray levels reaches the number of gray levels 2^j of the image signal (Step S9). In Step S8, a maximum number of 2^i−2 gray levels can be generated and added between gray levels Gp−1 and Gp+1 by performing FRC handling two frames as one set. If the number of gray levels is still insufficient after adding pseudo gray levels in Step S8, further pseudo gray levels can be generated by FRC handing three frames or five frames as one set and added between gray levels Gp−1 and Gp+1. Needless to say, the order of additional pseudo gray levels is determined according to their luminance levels.

Next, a specific example of the display method of this preferred embodiment is shown in Table 6.

TABLE 6

| Data driver IC output (6-bit gray level) | | Luminance level by FRC ⇒ Image signal (8-bit gray level) | | |
|---|---|---|---|---|
| [0] | | [0] | ⇒ | [0] |
| | | [0] × ¾ + [1] × ¼ | ⇒ | [1] |
| | | [0] × ¾ + [1] × ¾ | ⇒ | [2] |
| | | [0] × ¼ + [1] × ¾ | ⇒ | [3] |
| [1] | | [1] | ⇒ | [4] |
| | * | [0] × ½ + [2] × ½ | ⇒ | [5] |
| | | [1] × ¾ + [2] × ¼ | ⇒ | [6] |
| | | [1] × ¾ + [2] × ¾ | ⇒ | [7] |
| | | [1] × ¼ + [2] × ¾ | ⇒ | [8] |
| [2] | | [2] | ⇒ | [9] |
| | * | [1] × ½ + [3] × ½ | ⇒ | [10] |
| | | [2] × ¾ + [3] × ¼ | ⇒ | [11] |
| | | [2] × ¾ + [3] × ¾ | ⇒ | [12] |
| | | [2] × ¼ + [3] × ¾ | ⇒ | [13] |
| [3] | | [3] | ⇒ | [14] |
| | * | [2] × ½ + [4] × ½ | ⇒ | [15] |
| | | [3] × ¾ + [4] × ¼ | ⇒ | [16] |
| | | [3] × ¾ + [4] × ¾ | ⇒ | [17] |
| | | [3] × ¼ + [4] × ¾ | ⇒ | [18] |
| [4] | | [4] | ⇒ | [19] |
| | | [0] × ½ + [5] × ¼ | ⇒ | [20] |
| | | [4] × ¾ + [5] × ¾ | ⇒ | [21] |
| | | [4] × ¼ + [5] × ¾ | ⇒ | [22] |
| . | | . | | . |
| . | | . | | . |
| . | | . | | . |
| [61] | | [61] | ⇒ | [247] |
| | | [61] × ¾ + [62] × ¼ | ⇒ | [248] |
| | | [61] × ¾ + [62] × ¾ | ⇒ | [249] |
| | | [61] × ¼ + [62] × ¾ | ⇒ | [250] |
| [62] | | [62] | ⇒ | [251] |
| | | [62] × ¾ + [63] × ¼ | ⇒ | [252] |
| | | [62] × ¾ + [63] × ¾ | ⇒ | [253] |
| | | [62] × ¼ + [63] × ¾ | ⇒ | [254] |
| [63] | | [63] | ⇒ | [255] |

Table 6 shows an example in which 8-bit gray-level data (256 gray levels) is displayed with a data driver IC 2 having a 6-bit output (64 gray levels). First, FRC is applied while handling four frames (2^(8−6) frames) as one set, so as to generate three pseudo gray levels between the individual 6-bit gray levels. This process corresponds to Step S7, and the total number of gray levels, including the generated pseudo gray levels, is (64−1)×4+1=253. The number of gray levels is fewer by 3 than the 256 gray levels of the input image signal.

Then, between the gray levels [0] and [2], FRC is performed using two frames as one set, so as to generate a pseudo gray level having a luminance level of {[0]×½+[2]×½} (Step S8). The luminance level of this pseudo gray level is compared with the luminance levels of the seven gray levels including the pseudo gray levels added in Step S7 between the gray levels [0] and [2], and they are associated with 8-bit gray levels from the lower levels. In the example of FIG. 6, the pseudo gray level having the luminance level {[0]×½+[2]×½} is set as {5} in the 8-bit gray level representation.

Similarly, between the gray levels [1] and [3], FRC is performed using two frames as one set, so as to generate a pseudo gray level having a luminance level {[1]×½+[3]×½}, and it is set as {10} in the 8-bit gray level representation. Also, between the gray levels [2] and [4], FRC is performed using two frames as one set, so as to generate a pseudo gray level having a luminance level {[2]×½+[4]×½}, and it is set as {15} in the 8-bit gray level representation.

In the display method of this preferred embodiment, for the lack of gray levels, FRC is applied to two consecutive intervals between gray levels by handling two frames as one set, to add a pseudo gray level. However, when the display method of this preferred embodiment is applied to gray levels in a range where the display apparatus exhibits a linear gray level—luminance (level) characteristic, it is likely that pseudo gray levels and normal gray levels will have no difference in luminance level. Accordingly, it is desired for the display method of this preferred embodiment that the pseudo gray levels generated in Step S8 especially be applied to ranges in which the display apparatus exhibits a nonlinear gray level—luminance (level) characteristic.

As described above, according to the display method of this preferred embodiment and the display apparatus using this display method, a pseudo gray level generated by FRC handling two frames as one set is added into two consecutive intervals between gray levels, whereby the frequency of FRC is higher than when pseudo gray levels are generated by FRC handling three frames as one set as shown in the first preferred embodiment, which reduces flicker when luminance differences between gray levels are relatively small.

Fourth Preferred Embodiment

Figure 7:
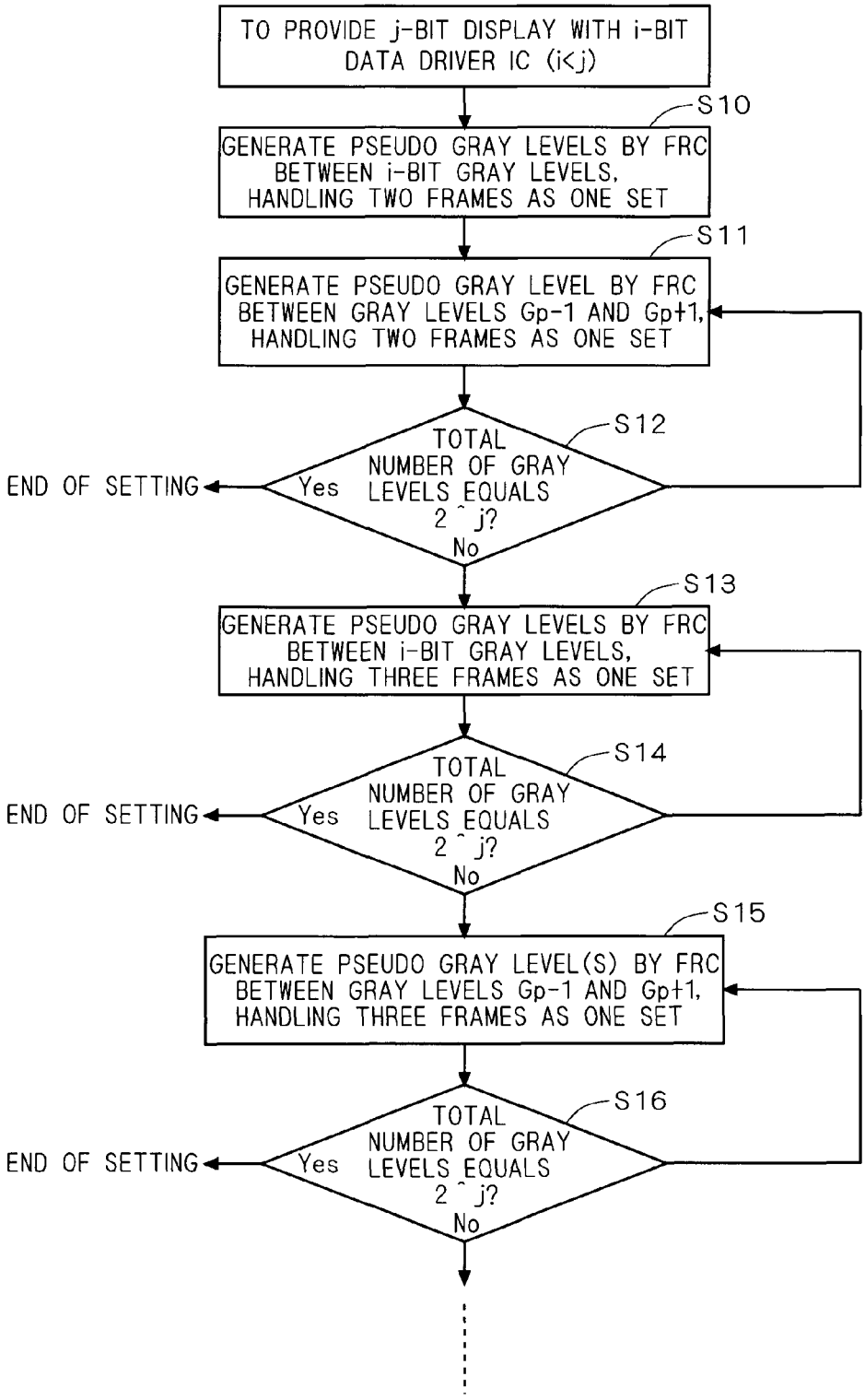
FIG. 7 is a flowchart illustrating a display method according to a fourth preferred embodiment of the present invention.

FIG. 7 is a flowchart illustrating a display method according to this preferred embodiment. The flowchart of FIG. 7 shows a display method in which the gray levels of a j-bit image signal is displayed by using a data driver IC 2 capable of outputting i-bit gray-level data (i<j). First, FRC is performed while handling two frames as one set to generate pseudo gray levels between the individual i-bit gray levels (Step S10). For example, between gray levels Gp and Gp+1, FRC using two frames as one set is performed to add a pseudo gray level {Gp×½+(Gp+1)×½}. The number of gray levels added in Step S10 is [2^i−1].

Next, a pseudo gray level generated by FRC handling two frames as one set is added between two gray levels that are separated from each other by one gray level (into the two consecutive intervals between the gray levels) among the i-bit gray levels (Step S11). For example, between gray levels Gp−1 and Gp+1, FRC with two frames as one set is performed to add a pseudo gray level {(Gp−1)×½+(Gp+1)×½}. The number of gray levels added in Step S11 is [2^i×2]. Among the pseudo gray levels generated in Step S11, pseudo gray levels having luminance levels equivalent to those of the i-bit gray levels or pseudo gray levels generated in Step S10 are removed.

Next, in Step S12, it is determined whether the total number of gray levels, including pseudo gray levels added in Steps S10 and S11 and the i-bit gray levels, satisfies the number of gray levels 2^j of the image signal. Then, when Step S12 determines that the total number of gray levels satisfies the number of gray levels 2^j of the image signal, the setting of pseudo gray levels is ended; if not so, the process moves to Step S13.

Next, in Step S13, pseudo gray levels produced by FRC handling three frames as one set are added between individual i-bit gray levels. For example, between gray levels Gp and Gp+1, FRC using three frames as one set is performed to generate and add pseudo gray levels {Gp×⅔+(Gp+1)×⅓} and {Gp×⅓+(Gp+1)×⅔}. The number of gray levels added in Step S13 is {2×(2^i×1)}. Among the pseudo gray levels generated in Step S13, pseudo gray levels having luminance levels equivalent to those of the i-bit gray levels or pseudo gray levels generated in Steps S10 and S11 are removed.

Next, in Step S14, it is determined whether the total number of gray levels, including the pseudo gray levels added in Steps S10, S11 and S13 and the i-bit gray levels, satisfies the number of gray levels 2^j of the image signal. Then, when Step S14 determines that the total number of gray levels satisfies the number of gray levels 2^j of the image signal, the setting of pseudo gray levels is ended; if not so, the process moves to Step S15.

Next, in Step S15, pseudo gray levels generated by FRC handling three frames as one set are added between two gray levels that are separated from each other by one gray level (into the two consecutive intervals between the gray levels) among the i-bit gray levels. For example, between gray levels Gp−1 and Gp+1, FRC using three frames as one set is performed to add pseudo gray levels {(Gp−1)×⅔+(Gp+1)×⅓} and {(Gp−1)×⅓+(Gp+1)×⅔}. The number of gray levels added in Step S15 is {2×(2^i×2)}. Among the pseudo gray levels generated in Step S15, pseudo gray levels having luminance levels equivalent to those of the i-bit gray levels or pseudo gray levels generated in Steps S10, S11 and S13 are removed.

Next, in Step S16, it is determined whether the total number of gray levels, including the pseudo gray levels added in Steps S10, S11, S13 and S15 and the i-bit gray levels, satisfies the number of gray levels 2^j of the image signal. Then, when Step S16 determines that the total number of gray levels satisfies the number of gray levels 2^j of the image signal, the setting of pseudo gray levels is ended; if not so, the process moves to the next step.

In the next and following steps, processes equivalent to those of Steps S13 to S16 are performed while sequentially increasing the number of frames, as 4, 5, 6 and so on. That is, pseudo gray levels generated by FRC between individual gray levels by using N frames as one set, and pseudo gray levels generated by FRC in individual two consecutive intervals between gray levels by using N frames as one set, are sequentially added until the total number of gray levels attains the number of gray levels 2^j of the image signal.

As described above, according to the display method of this preferred embodiment, pseudo gray levels generated by applying FRC between individual gray levels by using N frames as one set, and pseudo gray levels generated by applying FRC to individual two consecutive intervals between gray levels by using N frames as one set, are sequentially added while sequentially increasing the value of N (a natural number of 2 or larger), until the total number of gray levels attains the number of gray levels of the image signal. Thus, the display method of this preferred embodiment and the display apparatus using the display method generate pseudo gray levels from the higher FRC frequencies, whereby a larger number of higher-frequency pseudo gray levels are generated, and flicker is reduced when luminance differences between gray levels are relatively small.

While the invention has been described in detail, the foregoing description is in all aspects illustrative and not restrictive. It is understood that numerous other modifications and variations can be devised without departing from the scope of the invention.

What is claimed is:

1. A display method which allows a display apparatus to display gray levels represented by a first number of bits of an image signal inputted to a driver circuit that drives said display apparatus, when said first number of bits is larger than a second number of bits of gray-level data outputted from said driver circuit, said method comprising:

a first pseudo gray-level display step of performing frame rate control so as to add first pseudo gray levels, using a first number of frames to display each of the first pseudo gray levels, into intervals between individual gray levels represented by said second number of bits; and a second pseudo gray-level display step of performing frame rate control so as to add at least one second pseudo gray level, using a second number of frames to display the second pseudo gray level, into at least one of the intervals between the individual gray levels to which said first pseudo gray-level display step has been applied, said second number of frames being different from said first number of frames.

2. The display method according to claim 1, further comprising:

a pseudo gray-level adding step of, when the gray levels represented by said first number of bits cannot be displayed after the first and second pseudo gray levels are added in said first pseudo gray-level display step and said second pseudo gray-level display step, performing frame rate control so as to sequentially add a third pseudo gray level or levels, using a third number of frames to display the third pseudo gray level, until the number of gray levels represented by said first number of bits is reached, said third number of frames being different from said first number of frames and said second number of frames.

3. The display method according to claim 1, wherein said first number of frames is 2 raised to the power of a difference between said first number of bits and said second number of bits.

4. The display method according to claim 1, wherein said second number of frames is a natural number that is smaller than 2 raised to the power of a difference between said first number of bits and said second number of bits.

5. The display method according to claim 1, wherein said first number of frames is 2 and said second number of frames is 3.

6. The display method according to claim 2, wherein said first number of frames is 2, said second number of frames is 3, and said third number of frames is a natural number of 4 or larger, and said third number of frames is sequentially increased until the number of gray levels represented by said first number of bits is reached.

7. A display method which allows a display apparatus to display gray levels represented by a first number of bits of an image signal inputted to a driver circuit that drives said display apparatus, when said first number of bits is larger than a second number of bits of gray-level data outputted from said driver circuit, said method comprising:

a first pseudo gray-level display step of performing frame rate control so as to add first pseudo gray levels, using a first number of frames to display each of the first pseudo gray levels, into intervals between adjacent ones of gray levels represented by said second number of bits; and a second pseudo gray-level display step of performing frame rate control so as to add at least one second pseudo gray level, using a second number of frames to display the second pseudo gray level, into at least one of two consecutive intervals between the gray levels represented by said second number of bits.

8. The display method according to claim 7, wherein the first number of frames is different from the second number of frames.

9. The display method according to claim 7, further comprising:

a pseudo gray-level adding step of, when the gray levels represented by said first number of bits cannot be displayed after the first and second pseudo gray levels are added in said first pseudo gray-level display step and said second pseudo gray-level display step, repeating said first pseudo gray-level display step and said second pseudo gray-level display step while sequentially increasing at least one of the first and second number of frames, so as to sequentially add a further pseudo gray level or levels until the number of gray levels represented by said first number of bits is reached.

10. The display method according to claim 7, wherein said second pseudo gray-level display step is applied to a gray-level range in which said display apparatus exhibits a nonlinear gray level-luminance characteristic curve.

11. A display apparatus which displays gray-level data represented by a first number of bits of an image signal inputted to a driver circuit that drives said display apparatus, by using a display method which allows said display apparatus to display gray levels represented by said first number of bits when said first number of bits is larger than a second number of bits of gray-level data outputted from said driver circuit, said apparatus comprising:

a controller configured to execute a method, said method including, a first pseudo gray-level display step of performing frame rate control so as to add first pseudo gray levels, using a first number of frames to display each of the first pseudo gray levels, into intervals between individual gray levels represented by said second number of bits, and a second pseudo gray-level display step of performing frame rate control so as to add at least one second pseudo gray level, using a second number of frames to display the second pseudo gray level, into at least one of the intervals between the individual gray levels to which said first pseudo gray-level display step has been applied, said second number of frames being different from said first number of frames.

12. A display apparatus which displays gray-level data represented by a first number of bits of an image signal inputted to a driver circuit that drives said display apparatus, by using a display method which allows said display apparatus to display gray levels represented by said first number of bits when said first number of bits is larger than a second number of bits of gray-level data outputted from said driver circuit, said apparatus comprising:

a controller configured to execute a method, said method including, a first pseudo gray-level display step of performing frame rate control so as to add first pseudo gray levels, using a first number of frames to display each of the first pseudo gray levels, into intervals between adjacent ones of gray levels represented by said second number of bits, and a second pseudo gray-level display step of performing frame rate control so as to add at least one second pseudo gray level, using a second number of frames to display the second pseudo gray level, into at least one of two consecutive intervals between the gray levels represented by said second number of bits.

* * * * *